US005642924A

United States Patent [19]

Wohlrab et al.

[11] Patent Number: 5,642,924

[45] Date of Patent: Jul. 1, 1997

[54] SHELF SYSTEM FOR A REFRIGERATOR CABINET

[75] Inventors: Chad A. Wohlrab, Greenville; John A. Powers, Sand Lake; Michael C. Fessenden, Belmont, all of Mich.

[73] Assignee: White Consolidated Industries, Inc., Cleveland, Ohio

[21] Appl. No.: 608,685

[22] Filed: Feb. 29, 1996

[51] Int. Cl.[6] ..... A47B 96/04

[52] U.S. Cl. ..... 312/408; 211/134

[58] Field of Search ..... 312/334.44, 406, 312/408; 211/134; 108/107, 108

[56] References Cited

U.S. PATENT DOCUMENTS

| | | | |
|---|---|---|---|
| Re. 19,798 | 12/1935 | Copeman . | |
| 1,191,198 | 7/1916 | Kunn et al. . | |
| 2,033,861 | 3/1936 | Otte | 312/408 |
| 2,078,681 | 4/1937 | Otte . | |
| 2,168,172 | 8/1939 | Rees . | |
| 2,287,611 | 6/1942 | Harbison . | |
| 2,549,879 | 4/1951 | Amore | 312/408 |
| 2,611,675 | 9/1952 | Palmer . | |
| 2,633,400 | 3/1953 | Ring . | |
| 3,097,901 | 7/1963 | Schless, Jr. . | |
| 3,178,249 | 4/1965 | Willis et al. . | |
| 3,220,364 | 11/1965 | Sandin . | |
| 3,279,876 | 10/1966 | St. Cyr . | |
| 3,311,072 | 3/1967 | Pattison . | |
| 3,397,934 | 8/1968 | Dushek . | |
| 3,707,317 | 12/1972 | Dawley et al. . | |
| 3,751,126 | 8/1973 | Hudson | 312/408 |
| 3,857,624 | 12/1974 | Peterson . | |
| 3,859,932 | 1/1975 | Armstrong et al. . | |
| 3,865,448 | 2/1975 | Winterheimer . | |
| 3,940,195 | 2/1976 | Tillman . | |
| 3,984,163 | 10/1976 | Boorman, Jr. et al. . | |
| 4,098,481 | 7/1978 | Johnson et al. . | |
| 4,244,637 | 1/1981 | Boorman, Jr. . | |
| 4,250,815 | 2/1981 | Swanson . | |
| 4,319,792 | 3/1982 | Britt et al. . | |
| 4,326,390 | 4/1982 | Brooks . | |
| 4,348,960 | 9/1982 | Staurseth . | |
| 4,365,562 | 12/1982 | Webb . | |
| 4,596,195 | 6/1986 | Wenger . | |
| 4,736,997 | 4/1988 | Besore et al. . | |
| 4,904,032 | 2/1990 | Jenkins . | |
| 4,936,641 | 6/1990 | Bussan et al. . | |
| 5,004,302 | 4/1991 | Stocking et al. . | |
| 5,042,398 | 8/1991 | Lau et al. . | |
| 5,228,764 | 7/1993 | Cherry et al. . | |
| 5,361,599 | 11/1994 | Dasher . | |
| 5,403,083 | 4/1995 | Dasher et al. . | |

FOREIGN PATENT DOCUMENTS

| | | |
|---|---|---|
| 1379535 | 10/1964 | France . |
| 1064083 | 8/1959 | Germany . |

OTHER PUBLICATIONS

Photo of a refrigerator shelf of a refrigerator sold in the United States prior to 1980.

*Primary Examiner*—Peter M. Cuomo
*Assistant Examiner*—Gerald A. Anderson
*Attorney, Agent, or Firm*—Pearne, Gordon, McCoy & Granger LLP

[57] ABSTRACT

A refrigerator cabinet having a liner having sidewalls and a rear wall, each sidewall having a plurality of shelf supports mounted thereon, each shelf support including a supporting rail having a front portion and a rear portion separated by a gap, a cantilever half shelf and a full width sliding shelf mounted in the cabinet on the shelf supports, the sliding shelf having a depending stop in the gap engageable with the front portion of the supporting rail to stop forward motion, the cantilever half shelf having a cantilever arm cooperating with a bracket on the rear wall to prevent swinging motion, the cantilever half shelf also having a deflectable element or a plastic clip engageable with the front portion of the supporting rail to prevent swinging motion of the cantilever half shelf.

23 Claims, 5 Drawing Sheets

Fig.2
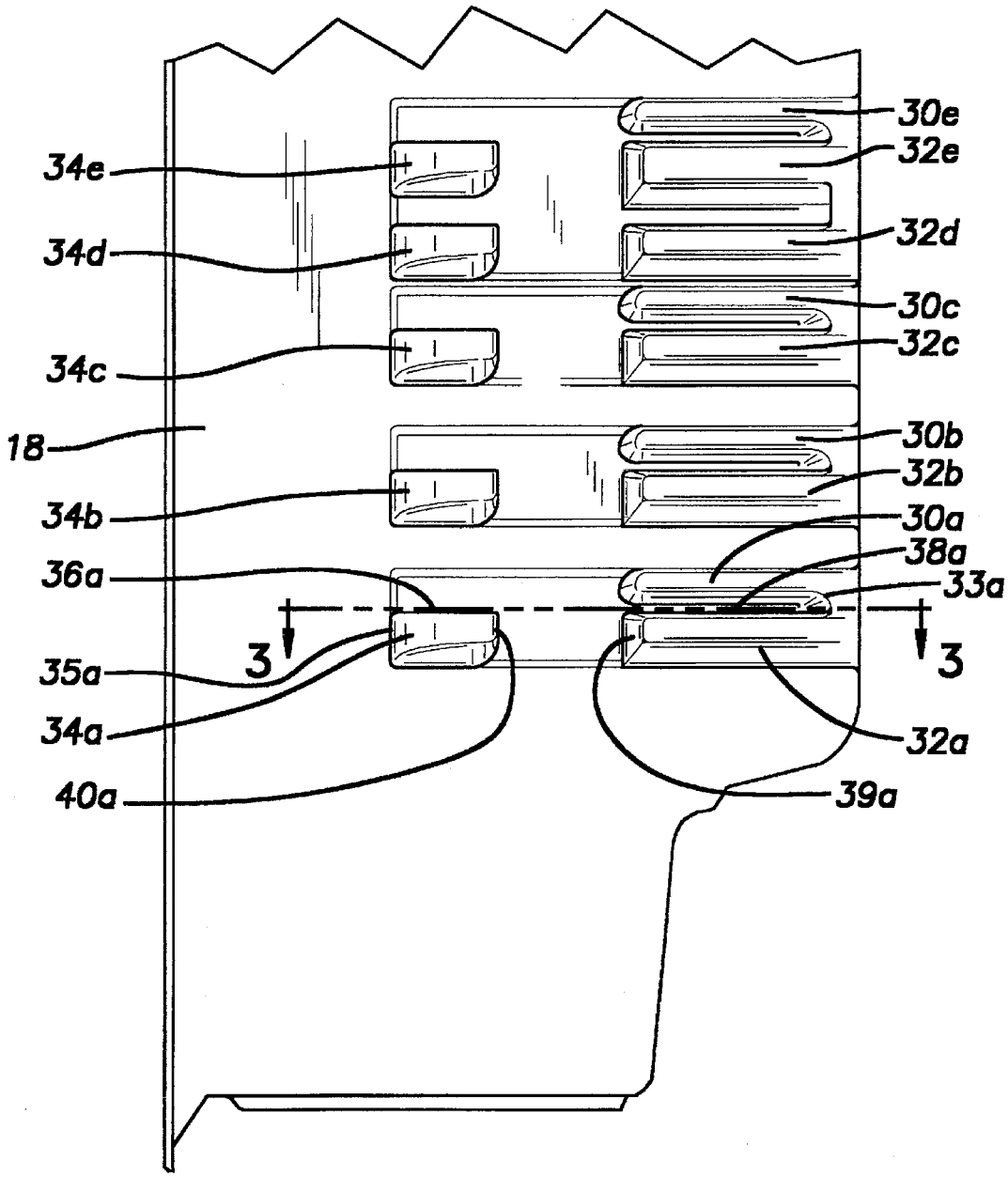
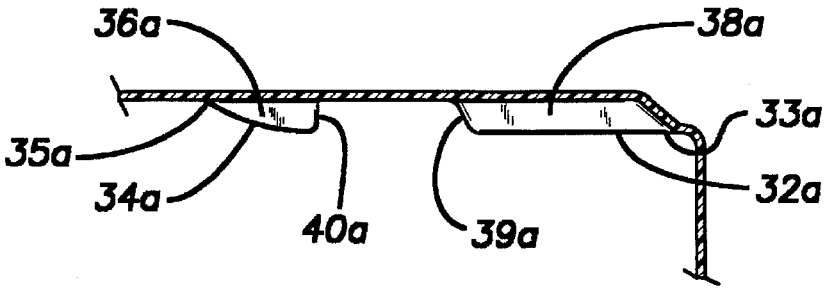
Fig.3

Fig.4
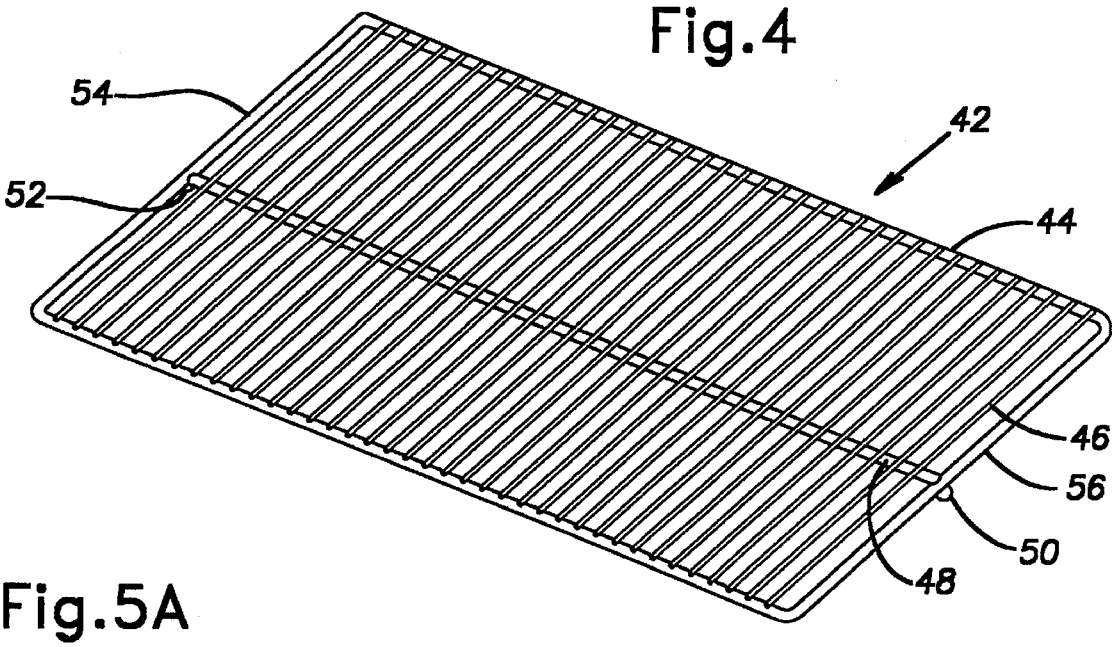
Fig.5A
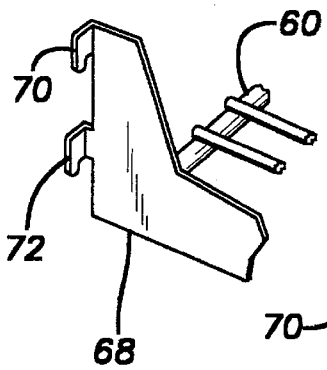
Fig.6A
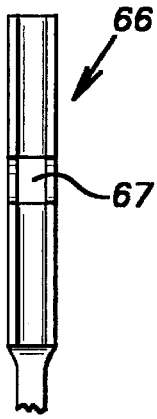
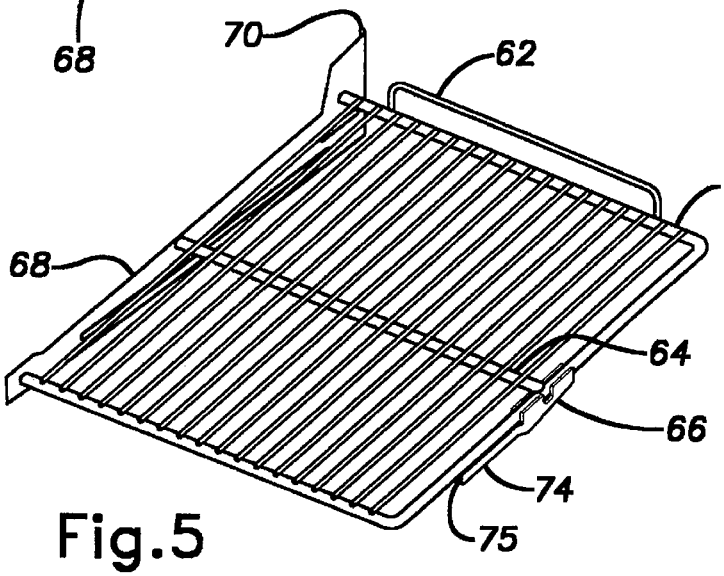
Fig.5
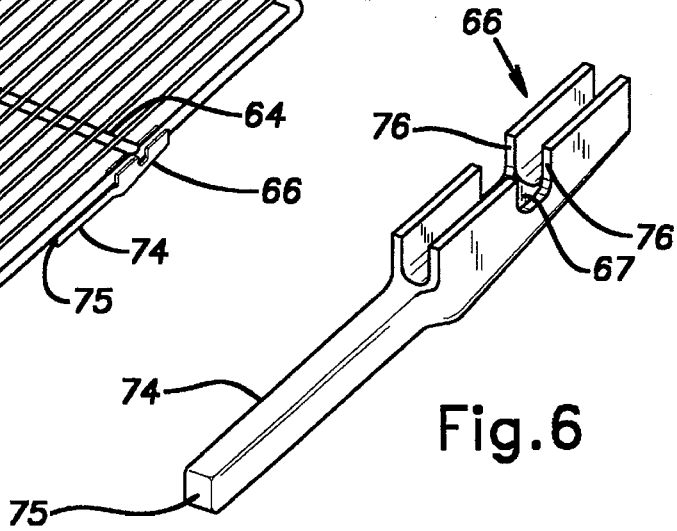
Fig.6

SHELF SYSTEM FOR A REFRIGERATOR CABINET

BACKGROUND OF THE INVENTION

The invention relates generally to refrigerators and more particularly to a shelf system for a refrigerator cabinet.

DESCRIPTION OF RELATED ART

A refrigerator cabinet frequently has a molded plastic liner with a number of shelf supports or shelf rails molded therein. These rails are at different heights so that the location of a particular shelf may be adjusted by removing it from one set of rails and repositioning it on another set of rails. Shelves utilized in these refrigerator cabinets include sliding shelves and cantilever half shelves. A sliding shelf typically extends the full width of the liner and rests on rails on opposing sidewalls. A cantilever half shelf is about ½ the width of the full width sliding shelf, ie, it is about ½ the width of the liner; one side of the cantilever half shelf engages and is supported by a rear wall bracket in the center of the liner rear wall and the other side of the cantilever half shelf rests on a rail on the sidewall of the liner.

One problem to which the invention is directed is to provide a set of rails or shelf supports each one of which can support, and accommodate the requirements of, either a sliding shelf or a cantilever half shelf. A second problem is to more effectively mitigate or prevent swinging or rotation of a cantilever half shelf around the axis defined by the rear wall bracket. Unless prevented, a cantilever half shelf may have a tendency to swing or rotate around the described axis and slip off the sidewall rail. The present invention addresses both these problems.

SUMMARY OF THE INVENTION

A refrigerator cabinet is disclosed having a liner having sidewalls and a rear wall, with a plurality of shelf supports mounted on each sidewall. A bracket is mounted on the rear wall, the bracket being adapted to support one side of a cantilever half shelf at a plurality of different heights. Each shelf support includes a supporting rail having a front portion and a rear portion separated by a gap, each supporting rail (1) being capable of supporting one side of a sliding shelf having a depending stop in the gap and (2) being capable of permitting the sliding shelf to slide forward a travel distance of at least two inches until forward motion is stopped by the depending stop engaging the front portion of the supporting rail, each supporting rail also being capable of supporting one side of a cantilever half shelf having an element cooperating with the front portion of the supporting rail to prevent swinging of the cantilever half shelf.

BRIEF DESCRIPTION OF THE DRAWINGS

FIG. 2 is a fragmentary elevational view of the left sidewall 18 of the cabinet of FIG. 1;

FIG. 3 is a sectional view taken along line 3—3 of FIG. 2.

FIG. 4 is a perspective view of a sliding shelf for use in the invention.

FIG. 5 is a perspective view of a cantilever half shelf, with clip attached in position, for use in the invention.

FIG. 5A is a fragmentary perspective view of the portion of the cantilever half shelf which engages the rear wall bracket.

FIG. 6 is a perspective view of the clip shown in FIG. 5.

FIG. 6A is a fragmentary top view of the clip shown in FIG. 6.

DETAILED DESCRIPTION OF THE PREFERRED EMBODIMENTS OF THE INVENTION

Figure 1:
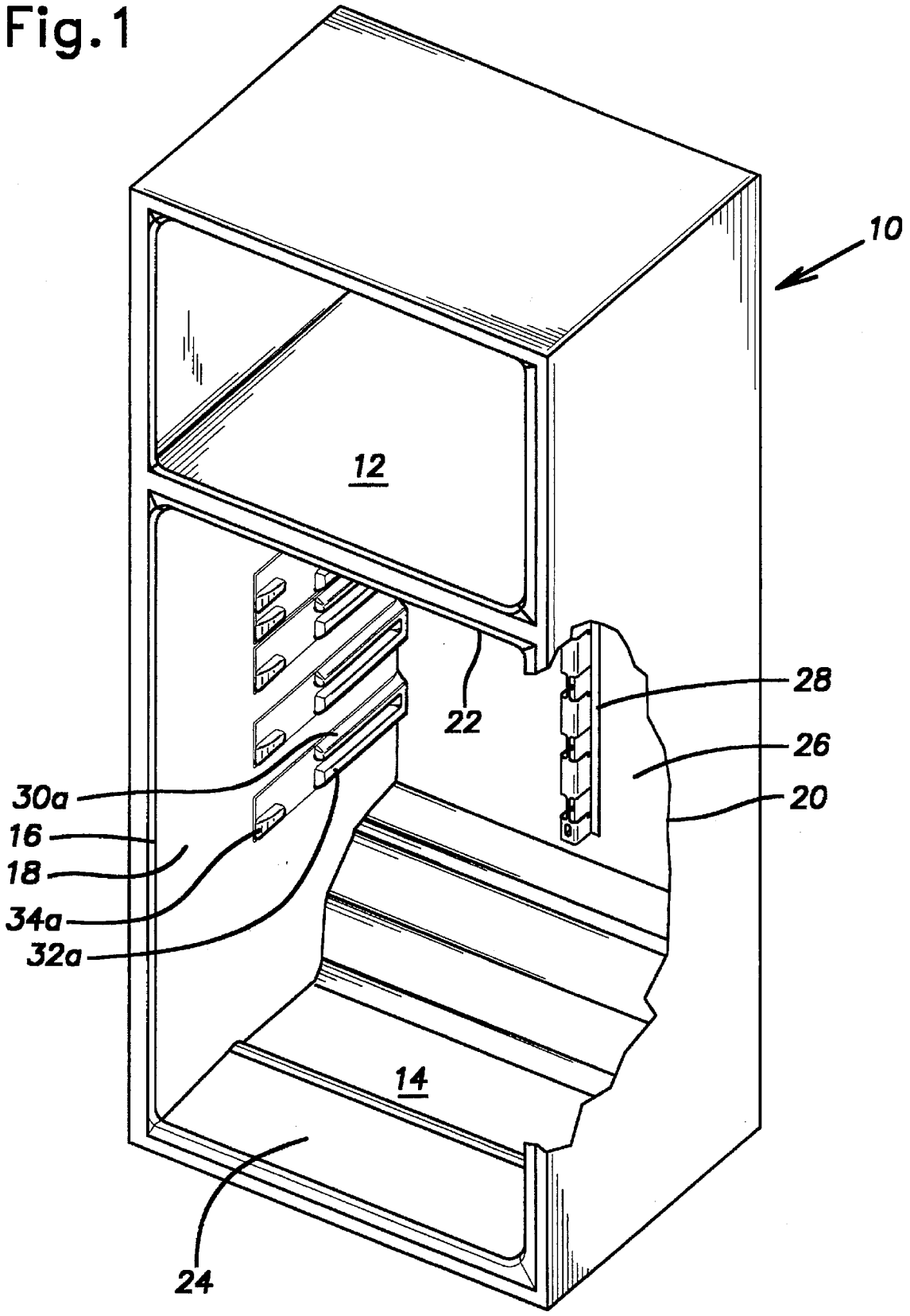
FIG. 1 is a perspective view of a refrigerator cabinet according to the present invention with a portion of the right wall cut away.

Referring to the drawings and particularly FIG. 1, there is shown a refrigerator cabinet 10 having a freezer compartment 12 and a fresh food cooling compartment 14. The fresh food compartment 14 is defined or substantially defined by a liner 16, which is preferably formed or molded plastic.

The liner 16 has a left sidewall 18, a substantially parallel right sidewall 20, a rear wall 26, and preferably a top wall 22 and a bottom wall 24. A rear wall bracket 28 is attached to the center of the rear wall 26.

With reference to FIGS. 1–3, there is shown a preferred number of shelf supports (including bottom supporting rails) molded integrally into the left sidewall 18 of the liner 16, although there may be more or less. The right sidewall 20 is preferably a mirror image of the left sidewall so that each shelf support has a corresponding shelf support on the other side in the same horizontal plane. With respect to the bottom shelf support in FIG. 2, also shown in FIG. 3, there is shown a bottom supporting rail having a front portion 34*a* (about three inches long), and a rear portion 32*a*, the front and rear portions being separated by a gap of at least 2, more preferably at least 3, more preferably at least 4, inches, measured from surface 40*a* to the midpoint of sloped surface 39*a*. The front portion 34*a* has a front end 35*a*, the rear portion 32*a* has a rear end 33*a*, and the gap has a midpoint which is closer to the front end 35*a* than to the rear end 33*a*. The gap is preferably longer than the length of the front portion 34*a*; the gap does not necessarily have to extend flush up against the liner as shown in FIG. 3, an indent or outbulging from the liner may be provided. From the midpoint of surface 39*a* to rear end 33*a* is about 6 inches, and this length is preferably more than the length of the front portion 34*a* and more than the length of the gap. A top retaining structure or rail 30*a* is also provided, which is free from a slot or groove on its bottom surface. Front portion 34*a* has a substantially flat supporting surface 36*a* and rear portion 32*a* has a substantially flat supporting surface 38*a*. These supporting surfaces 36*a*, 38*a* support a side of a shelf. Front portion 34*a* has a flat or substantially flat engaging surface 40*a*, which is a substantially flat rear end of front portion 34*a*, which rear end is (1) substantially perpendicular to the sidewall 18 to which it is adjacent and (2) substantially parallel to the rear wall 26; the substantially flat rear end 40*a* is preferably at least 6, more preferably at least 7, more preferably at least 8, more preferably at least 9.5, inches from the rear end 33*a*. Similar to the shelf support defined by elements 30*a*, 34*a*, and 32*a*, there are provided additional shelf supports defined by bottom supporting rails having front portions 34*b–e* and rear portions 32*b–e*, and top retaining rails 30*b*, 30*c*, and 30*e* (see FIG. 2). One rail can serve both supporting and retaining functions; see structure or rail 32*e*. The rails project out preferably about ⅝ to ¾ inches from the liner 16.

In FIG. 4 there is shown a sliding shelf 42 having a perimeter wire 44, cross wires 46, central support wire 48 and depending stops 50 and 52. Each stop is a steel ball (about 0.3 inch diameter) welded to and depending from the bottom of the perimeter wire 44 near the central support wire 48, stop 50 on the right side 56 and stop 52 on the left side 54 of the sliding shelf 42. Other depending stops can be substituted, such as other elements attached to the side of the shelf and performing the functions described herein, such as plastic or metal clips or knobs, etc.

In FIGS. 5, 5A, 6, and 6A, there is shown a cantilever half shelf 58 (about half the width of the sliding shelf 42) having a perimeter wire 60, a back wire stop 62 (for preventing food from sliding off the back of the shelf), a central support wire 64, and a cantilever arm 68 having mounting teeth 70, 72 perpendicular to the arm 68. Preferably the teeth are offset slightly so that tooth 70 is about ⅛ inch closer to the front of arm 68 (the vertical plane of tooth 72 is offset rearwardly from the vertical plane of tooth 70); the front of the shelf accordingly sticks up in the air a little when first mounted but the shelf levels out rear to front when a load (food) is applied; also this offset compensates for the fact that the width of the slot 82 (from the back of the refrigerator to the front of the refrigerator preferably about 0.156 inch) is greater than the metal thickness of the teeth 70, 72 (preferably 0.060 inch). The slot is made wide for ease of installation. The cantilever half shelf 58 is sized to fit the right side or half of the cabinet; there is a mirror image (not shown) for the left side or half of the cabinet). Attached to the cantilever half shelf 58 is a clip 66 (about 4 inches long and preferably of plastic). The clip has cutouts 76 (to accommodate the central support wire 64), an engaging hole 67, and a deflectable finger 74 terminating in a flat tip 75.

Figure 7:
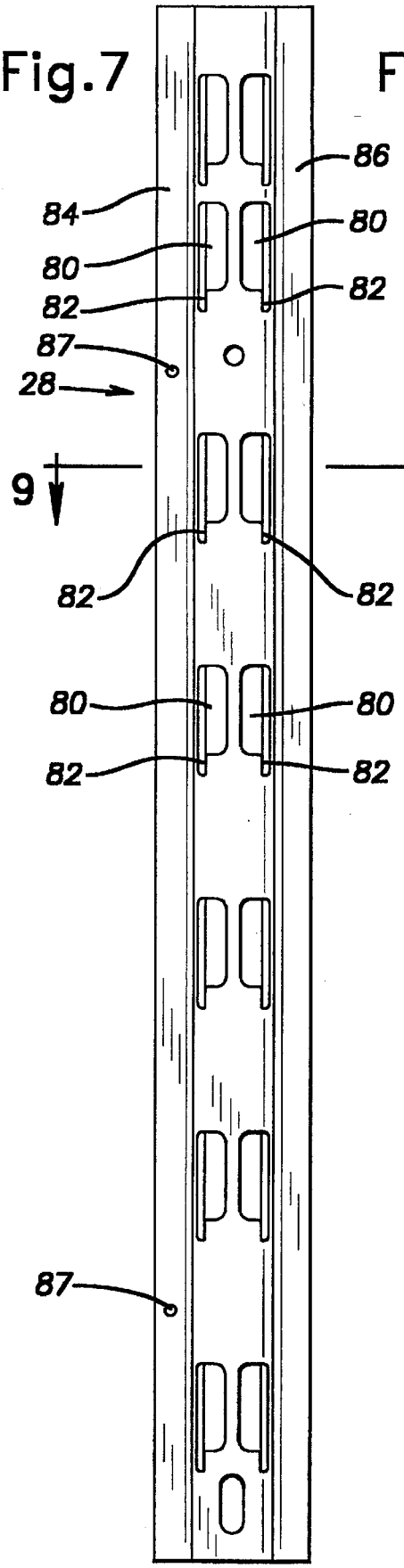
FIG. 7 is a front elevational view of the rear wall bracket also shown in FIG. 1.
Figure 8:
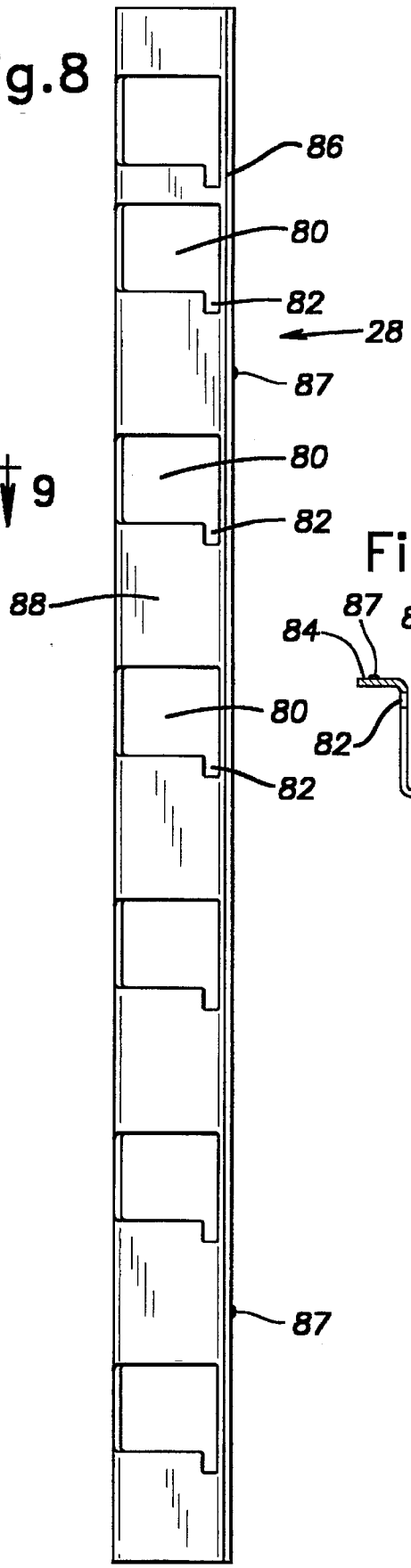
FIG. 8 is a side elevational view of the right side of the bracket of FIG. 7.
Figure 9:
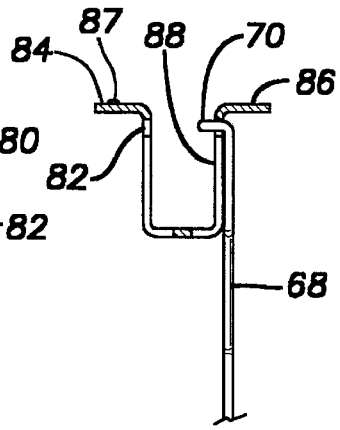
FIG. 9 is a sectional view of the bracket of FIG. 7 taken along line 9—9, with a portion of the cantilever half shelf of FIG. 5 attached thereto.

With reference to FIGS. 7–9, there is shown the rear wall bracket 28 having a series of openings 80, each opening 80 having a mounting slot 82; the bracket may less preferably be in separate segments. The cantilever arm 68 is mounted on the rear wall bracket 28 by engaging the mounting teeth 70, 72 in the slots 82. The shape of opening 80 permits the shelf 58 to be slid in from the front, dropped down and locked into place; this is much easier than bringing the shelf in from the side, where there is not much room. As can be seen in FIG. 7, the bracket 28 can accommodate cantilever half shelves hanging to its right as well as hanging to its left (on the right and left sides of the fresh food compartment), as well as at different heights. The bracket 28 has back flanges 84, 86 for engaging the rear wall 26 of the liner 16 and for resisting torque around the vertical axis defined by the bracket 28. Flange 84 has alignment detents 87, 87 where the metal has been deformed slightly to produce a small knob on the backside. Alignment holes are drilled in the rear wall 26 of liner 16 and the detents 87, 87 are nested or engaged therein to positively align and properly position the bracket 28 so the half shelves will be level side to side. As shown in FIGS. 7–9, the bracket 28 has a series of projecting faces 88 on its left and right sides. FIG. 9 shows the cantilever arm 68 mounted in the bracket 28 and it can be seen that the projecting face 88 acts as an interfering element for interfering with or to prevent rotation ("swinging") motion of the cantilever arm 68 beyond an insubstantial amount around the vertical axis defined by the bracket 28 (with respect to FIG. 9, clockwise motion of cantilever arm 68 about mounting tooth 70); one degree (1°), more preferably 3°, more preferably 5°, more preferably 7°, more preferably 10°, being an insubstantial amount; in FIG. 9 face 88 and arm 68 are preferably parallel (or substantially parallel) and in contact and are approximately parallel when they are within 5°, more preferably 8°, of being parallel; these measurements are not necessarily limiting. Mounting teeth 70, 72 being engaged in slots 82 results in the arm 68 cooperating with the bracket 28 to prevent substantially all lateral translation of the arm parallel with the rear wall and perpendicular to the sidewalls; this improves over a different design when the slots are on the front of the bracket and are about ¼ inch wide and the teeth are parallel with the body of the arm and simply hook into the bracket—in such a design there is about ¼ inch of slop or wiggle room, and the arm can translate laterally, possibly causing the shelf to translate or fall off the supporting rail. Preferably faces 88 are perpendicular to the flanges 84, 86.

Figure 10:
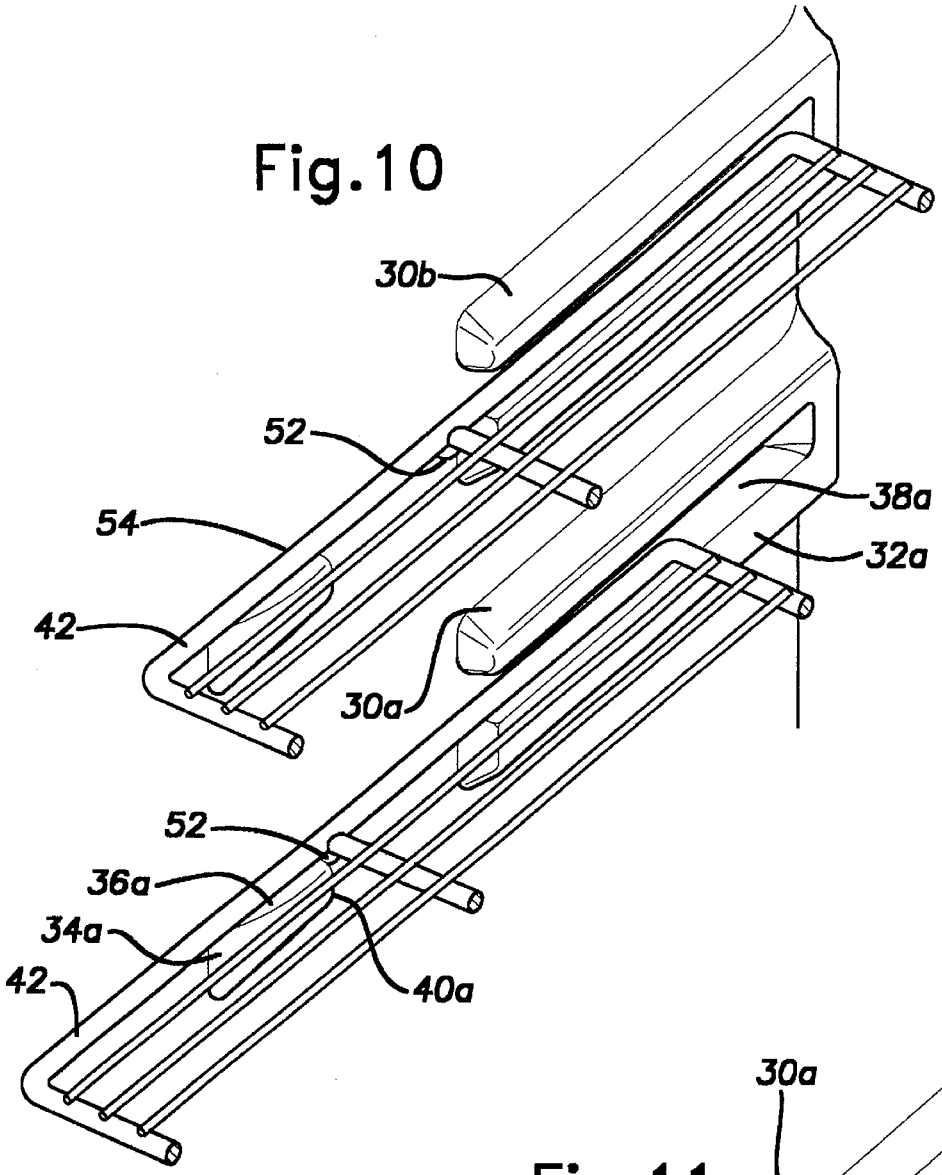
FIG. 10 is a fragmentary perspective view of two shelf supports on one of the sidewalls with two sliding shelves mounted thereon with one shelf in its rearward position and the other shelf in its forward retained position.

With reference to FIG. 10, there is shown two shelf supports on the left sidewall 18 with two sliding shelves 42 mounted thereon with the uppermost shelf in its rearward position (note stop 52 near the front of the rear portion 32*a* of the bottom supporting rail) and the other shelf in its forward retained position (note stop 52 contacting or engaging the engaging surface 40*a* of the forward portion 34*a* of the bottom supporting rail). The gap between the front and rear portions of the bottom supporting rail is about 4.3 inches. Thus, the sliding shelf may slide forward a travel distance of about 4.3 inches until forward motion is stopped by stop 52 engaging front portion 34*a* (at surface 40*a*); less preferable travel distances are 2, 3, and 4 inches; consumers prefer the longer travel distances so food at the back can be reached. The stop 52 is illustrative; any depending element attached to the undersurface of the perimeter wire 44 or thereabouts can stop forward travel of the sliding shelf. The top retaining rail 30*a*, is a structure which prevents the sliding shelf from tipping forward (when in its forward retained position) due to heavy food on the front of the shelf.

Figure 11:
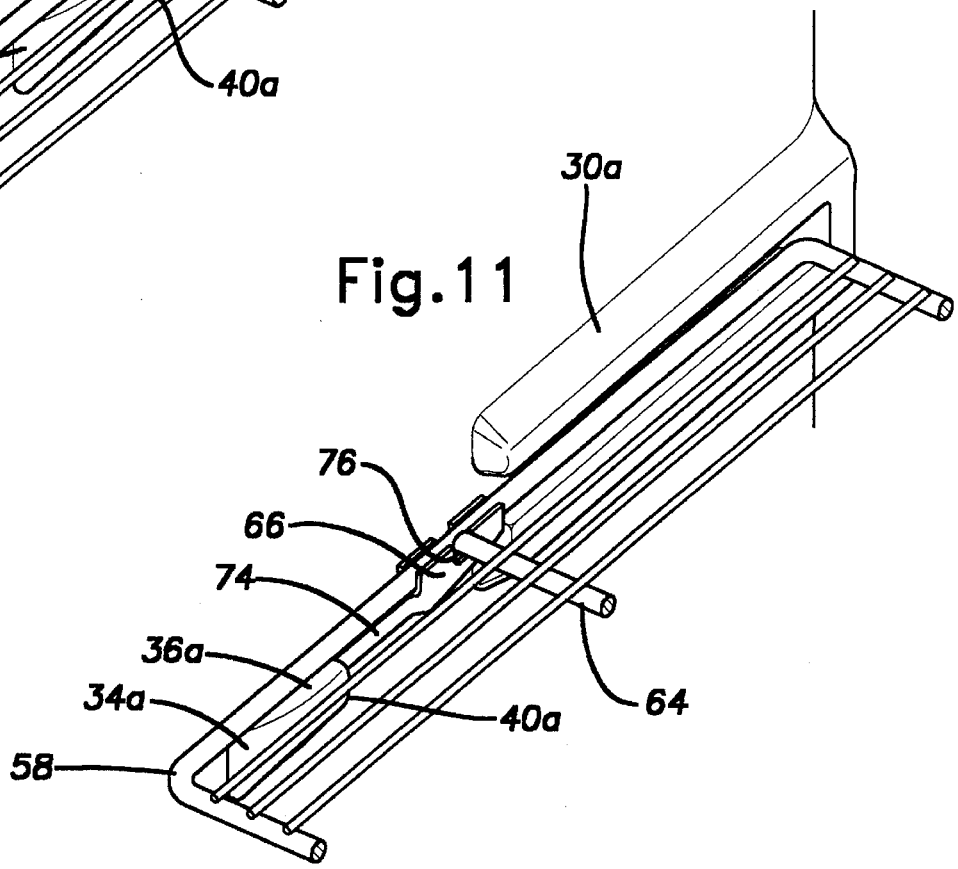
FIG. 11 is a fragmentary perspective view of a shelf support on one of the sidewalls with a cantilever half shelf mounted thereon.

FIG. 11 shows a cantilever half shelf 58 when it is mounted substantially flat in a shelf support. The flat tip 75 of the deflectable finger 74 engages the flat engaging surface 40*a* of the front portion 34*a* of the bottom supporting rail. The engaging fit is snug. This engagement, along with cutout 76 engaging wire 64 and the cantilever arm being attached to the rear wall bracket, prevents the cantilever half shelf from sliding forward. (If the cantilever half shelf does not have a central support wire 64 (as is the case when a plate of glass replaces the wire 64 and the cross wires to provide a glass cantilever half shelf) then translation of clip 66 along perimeter wire 60, as well as rotation around wire 60, is prevented by a depending stop or post such as a metal ball or post attached or welded to the underside of perimeter wire 60 nesting in or engaging the engaging hole 67). The engagement of tip 75 with surface 40*a* and the engagement of cantilever arm 68 with the projecting face 88 of the rear wall bracket both prevent rotation of the cantilever half shelf around the axis defined by the rear wall bracket (referred to herein as swinging), thus preventing the side of the cantilever half shelf from slipping off the supporting surfaces 36*a*, 38*a* of the bottom supporting rail. This is an example of an element cooperating with the front portion of the supporting rail to prevent swinging; other such elements include catches, which catch a groove in the front portion, hooks, hole and button arrangements, etc. Finger 74 is plastic, is a returningly deflectable element because it is returnable, after deflection or flexion, to its undeflected position, and is stiffly flexible because it is made of stiff, but flexible, plastic and will return on its own to its original position after flexion. In order to remove the cantilever half shelf, one flexes or deflects the finger 74 laterally away from the sidewall and in disengagement from the engaging surface 40*a* so that the finger 74 will ride over the front portion 34*a* of the bottom supporting rail. The teeth 70, 72 of the cantilever arm 68 are also disengaged from the rear wall bracket 28 and the cantilever half shelf is removed. To position a cantilever half shelf in a shelf support, the teeth 70, 72 are engaged in the rear wall bracket 28 and the finger 74 is deflected as it rides or slides over the front portion 34*a* until it snaps into position, the flat tip 75 engaging the engaging surface 40*a*. To remove the sliding shelf 42 for repositioning, the shelf is pulled forward until the stop engages the engaging surface 40*a*, then the shelf is tipped or lifted up and removed. As can be seen, the sliding shelf 42 and the cantilever half shelf 58 are positionally interchangeable on the various shelf supports.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigerator cabinet comprising a liner having substantially parallel sidewalls and a rear wall, the liner substantially defining a cooling compartment, each sidewall having a plurality of shelf supports mounted thereon, each shelf support on one sidewall having a corresponding shelf support in the same horizontal plane on the other sidewall, a bracket mounted on the rear wall, the bracket being adapted to support one side of a cantilever half shelf at a plurality of different heights such that at each such height, the other side of such cantilever half shelf may be supported by one of said shelf supports, each shelf support including a supporting rail having a front portion and a rear portion with said front portion and said rear portion being separated by a gap, each supporting rail (1) being capable of supporting one side of a sliding shelf having a depending stop in said gap and (2) being capable of permitting the sliding shelf to slide forward a travel distance of at least two inches until forward motion is stopped by the depending stop engaging the front portion of the supporting rail, each supporting rail also being capable of supporting one side of a cantilever half shelf having an element cooperating with the front portion of the supporting rail to prevent swinging of the cantilever half shelf.

2. A cabinet according to claim 1, with respect to each supporting rail said front portion having a front end, said rear portion having a rear end, said gap having a midpoint, said midpoint being closer to said front end than to said rear end.

3. A cabinet according to claim 1, each shelf support further including a structure capable of preventing a sliding shelf having a depending stop from tipping forward when said depending stop engages the front portion of the supporting rail of the shelf support.

4. A cabinet according to claim 3, wherein said preventing structure is a top retaining structure.

5. A cabinet according to claim 1, wherein said travel distance is at least three inches.

6. A cabinet according to claim 5, wherein said travel distance is at least four inches.

7. A cabinet according to claim 2, said front portion having a substantially flat rear end which is (1) substantially perpendicular to the sidewall to which it is adjacent and (2) substantially parallel to the rear wall.

8. A cabinet according to claim 7, the substantially flat rear end being at least 9.5 inches from the rear end of the rear portion.

9. A cabinet according to claim 1, said bracket adapted to engage a cantilever arm of a cantilever half shelf, said bracket having an interfering element for interfering with swinging motion of the cantilever half shelf beyond an insubstantial amount.

10. A cabinet according to claim 9, wherein said interfering element is a projecting face adapted to be parallel with and in contact with an adjacent portion of a cantilever arm and adapted to prevent said swinging motion.

11. A refrigerator cabinet comprising a liner having substantially parallel sidewalls and a rear wall, the liner substantially defining a cooling compartment, each sidewall having a plurality of shelf supports mounted thereon, each shelf support on one sidewall having a corresponding shelf support in the same horizontal plane on the other sidewall, a bracket mounted on the rear wall, the bracket supporting one side of a first cantilever half shelf at a preselected height with the other side of said first cantilever half shelf being supported by one of said shelf supports, said bracket being capable of supporting said first cantilever half shelf at at least one other height, each shelf support including a supporting rail having a front portion and a rear portion with said front portion and said rear portion being separated by a gap, a first sliding shelf supported by a first supporting rail on one sidewall and by a second supporting rail on the other sidewall in the same horizontal plane with the first supporting rail, said first sliding shelf having a depending stop in the gap in said first supporting rail, said first sliding shelf being capable of sliding forward a travel distance of at least two inches until forward motion is stopped by the depending stop engaging the front portion of the first supporting rail, each supporting rail (1) being capable of supporting one side of a second sliding shelf having a depending stop in said gap and (2) being capable of permitting such second sliding shelf to slide forward a travel distance of at least two inches until forward motion is stopped by the depending stop engaging the front portion of the supporting rail, each supporting rail also being capable of supporting one side of a second cantilever half shelf having an element cooperating with the front portion of the supporting rail to prevent swinging of such second cantilever half shelf.

12. A cabinet according to claim 11, with respect to each supporting rail said front portion having a front end, said rear portion having a rear end, said gap having a midpoint, said midpoint being closer to said front end than to said rear end.

13. A cabinet according to claim 11, each shelf support further including a structure capable of preventing said second sliding shelf having a depending stop from tipping forward when said depending stop engages the front portion of the supporting rail of the shelf support.

14. A cabinet according to claim 13, wherein said preventing structure is a top retaining structure.

15. A cabinet according to claim 12, said front portion having a substantially flat rear end which is (1) substantially perpendicular to the sidewall to which it is adjacent and (2) substantially parallel to the rear wall.

16. A cabinet according to claim 11, said other side of said first cantilever half shelf being supported by a third supporting rail having a third front portion and a third rear portion separated by a gap, said first cantilever half shelf having a returningly deflectable element cooperating with said third front portion to prevent swinging of said first cantilever half shelf.

17. A cabinet according to claim 16, said third front portion having a substantially flat rear end which is (1) substantially perpendicular to the sidewall to which it is adjacent and (2) substantially parallel to the rear wall, said returningly deflectable element being a stiffly flexible member engageable with said substantially flat rear end to prevent swinging of said first cantilever half shelf.

18. A cabinet according to claim 17, said first cantilever half shelf having a central support wire, said stiffly flexible member being a plastic clip attached to said other side of said first cantilever half shelf and engaging said central support wire, said clip having a stiffly flexible finger.

19. A cabinet according to claim 16, said first cantilever half shelf having a cantilever arm engaging said bracket, said bracket having an interfering element for interfering with swinging motion of said first cantilever half shelf beyond an insubstantial amount.

20. A cabinet according to claim 19, said interfering element being a projecting face substantially parallel with and in contact with an adjacent portion of said cantilever arm for preventing said swinging motion.

21. A cabinet according to claim 17, said first cantilever half shelf having a perimeter wire, said stiffly flexible member being a plastic clip attached to said perimeter wire, said plastic clip having an engaging hole engaging a stop depending from the underside of said perimeter wire.

22. A cabinet according to claim 20, said bracket having an alignment detent.

23. A cabinet according to claim 16, said first cantilever half shelf having a cantilever arm engaging said bracket and cooperating with said bracket to prevent substantially all lateral translation of said arm parallel with said rear wall and perpendicular to said sidewalls.

* * * * *